US009465340B2

(12) United States Patent
Hashimoto

(10) Patent No.: US 9,465,340 B2
(45) Date of Patent: Oct. 11, 2016

(54) METHOD OF DETERMINING WHETHER OR NOT TO PERFORM A DECOLORING PROCESS, AND DECOLORING DEVICE

(71) Applicants: KABUSHIKI KAISHA TOSHIBA, Tokyo (JP); TOSHIBA TEC KABUSHIKI KAISHA, Tokyo (JP)

(72) Inventor: Yoshihisa Hashimoto, Gotemba Shizuoka (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/455,695

(22) Filed: Aug. 8, 2014

(65) Prior Publication Data

US 2016/0041514 A1 Feb. 11, 2016

(51) Int. Cl.
*G03G 15/00* (2006.01)
*G03G 15/01* (2006.01)

(52) U.S. Cl.
CPC ..... *G03G 15/50* (2013.01); *G03G 15/01* (2013.01)

(58) Field of Classification Search
CPC ..... G03G 15/50; G03G 15/01; H04N 1/38; H04N 1/387; B41J 29/16
USPC ..... 399/67
See application file for complete search history.

(56) References Cited

U.S. PATENT DOCUMENTS

| | | | | |
|---|---|---|---|---|
| 6,535,706 | B1 * | 3/2003 | Konno | 399/182 |
| 8,670,011 | B2 | 3/2014 | Mizutani et al. | |
| 2011/0222130 | A1 * | 9/2011 | Iguchi et al. | 358/452 |
| 2011/0234721 | A1 | 9/2011 | Endo | |
| 2012/0306983 | A1 * | 12/2012 | Mizutani et al. | 347/179 |
| 2013/0070265 | A1 * | 3/2013 | Megawa | H04N 1/40 358/1.9 |

OTHER PUBLICATIONS

U.S. Appl. No. 14/181,294, filed Feb. 14, 2014, Inventor: Isao Yahata.
U.S. Appl. No. 14/305,369, filed Jun. 16, 2014, Inventor: Yoichi Yamaguchi.

* cited by examiner

*Primary Examiner* — Walter L Lindsay, Jr.
*Assistant Examiner* — Jessica L Eley
(74) *Attorney, Agent, or Firm* — Patterson & Sheridan, LLP

(57) ABSTRACT

A decoloring device according to an embodiment includes a feeding unit on which sheets are loaded. A first sensor unit is downstream of the feeding unit in a sheet transport direction, detects a front position of the sheet fed from the feeding unit, and detects a presence or absence of an identification mark on a front portion of the sheet outside of an image forming area of the sheet. A control unit determines whether or not an image using the decolorable color material is printed on any one or both sides of the sheet based on whether the first sensor detects an identification mark on the front portion of the sheet, and determines whether to perform the decoloring process based on the determination of whether or not an image using the decolorable color material is printed on the sheet.

14 Claims, 9 Drawing Sheets

| detector portion 12 / detector portion 11 | X0<X<X1 | X2<X<X3 | mark undetectable |
|---|---|---|---|
| X0<X<X1 | second side | both sides | first side |
| X2<X<X3 | both sides | second side | first side |
| mark undetectable | decoloring not | decoloring not | decoloring not |

FIG. 4C

| detector portion 12 / detector portion 11 | X0<X<X1 | X2<X<X3 | mark undetectable |
|---|---|---|---|
| X0<X<X1 | second side | both sides | first side |
| X2<X<X3 | both sides | second side | first side |
| mark undetectable | decoloring not | decoloring not | decoloring not |

METHOD OF DETERMINING WHETHER OR NOT TO PERFORM A DECOLORING PROCESS, AND DECOLORING DEVICE

FIELD

Embodiments described herein relate generally to a technology for determining whether or not an image printed on a sheet is an image which is suitable for a decoloring process.

BACKGROUND

In order to process a sheet for reuse, an image to be decolored is initially formed on the sheet using a decolorable color material, and then the image is decolored from the sheet by performing a decoloring process with respect to the image. For the decolorable color material, a decolorable toner may be used, for example. The decoloring toner is melted at a fixing temperature, and is fixed onto a sheet so that a color is developed. In addition, when a decoloring temperature higher than the fixing temperature is applied, an image of the decoloring toner which is already fixed is decolored.

In a decoloring unit which performs a decoloring process, only a sheet on which an image printed using the decoloring toner is fed. However, when a sheet on which an image which is printed using non-decolorable toner (hereinafter, referred to as ordinary toner) is fed in the decoloring unit by mistake, there is a problem in that an offset phenomenon occurs in which the ordinary toner is melted by being overheated. The melted ordinary toner then adheres to the face of a heating and pressuring member, such as a roller, included in the decoloring unit.

Accordingly, it is desirable to determine whether or not an image printed on a sheet is suitable for a decoloring process before performing the decoloring process in the decoloring unit.

BRIEF DESCRIPTION OF THE DRAWINGS

FIG. 4C is a table used for determining whether or not to perform the decoloring process.

DETAILED DESCRIPTION

Figure 1:
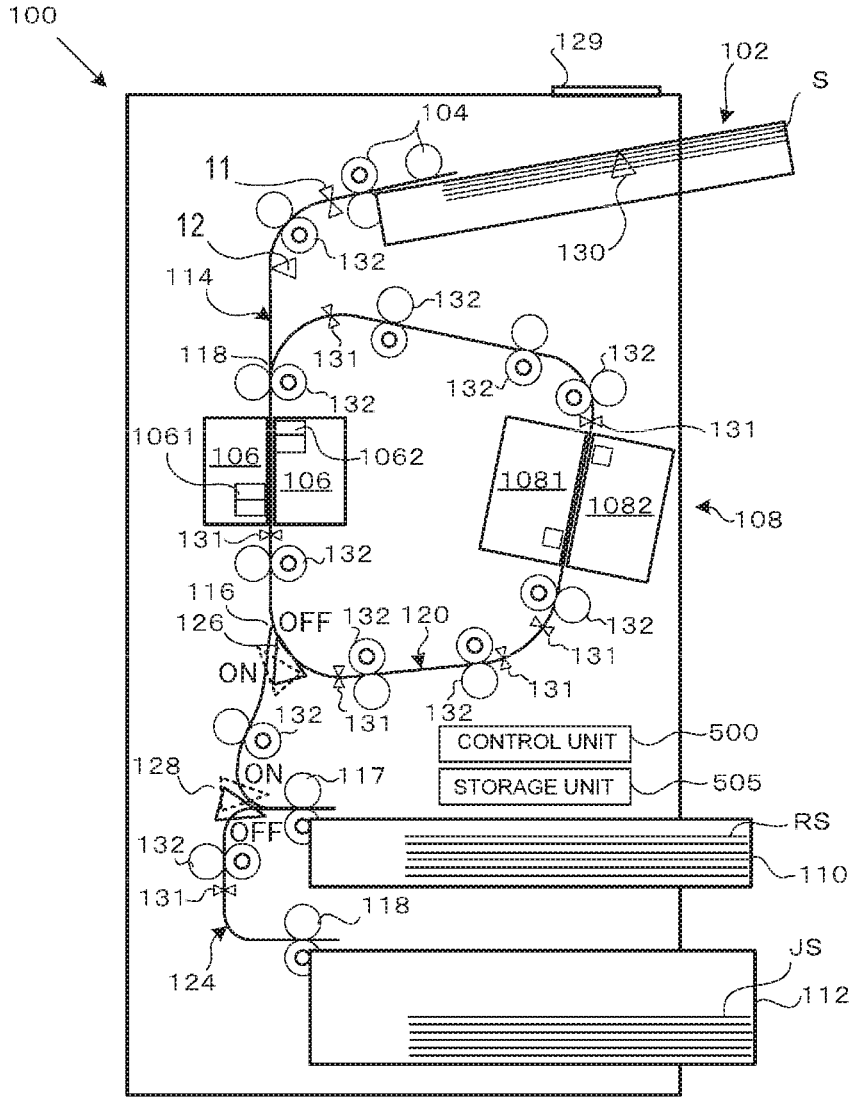
FIG. 1 is a schematic view of a decoloring device according to an embodiment.
Figure 2:
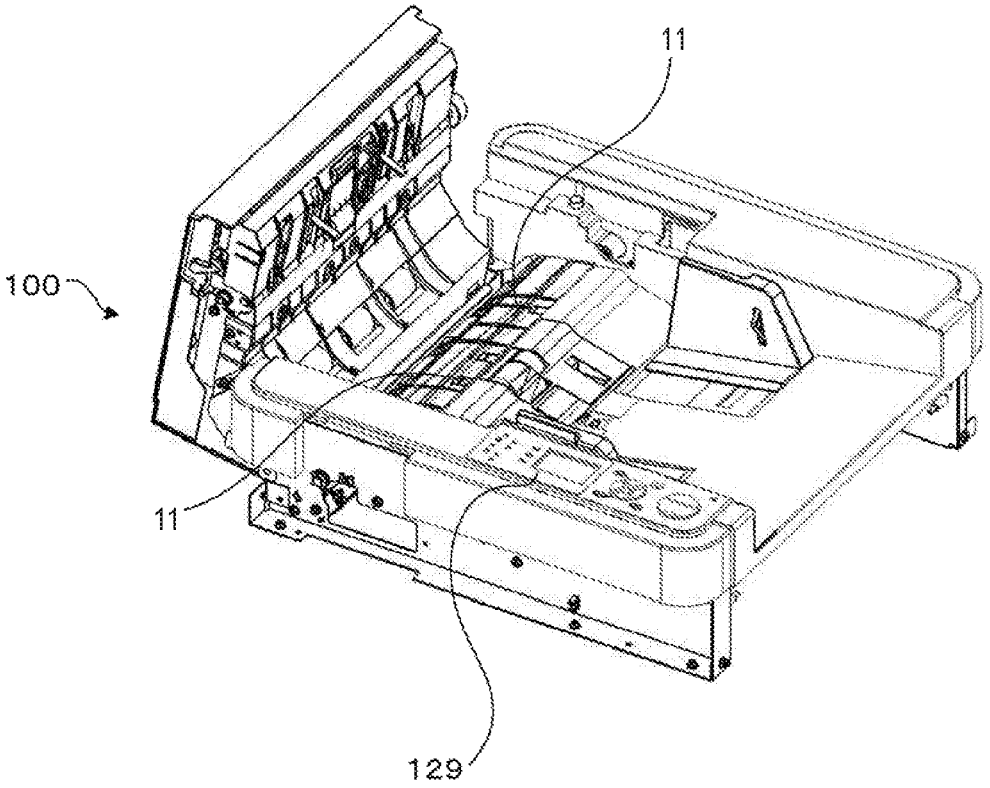
FIG. 2 is a perspective view of a feeding unit of the decoloring device in an open position.

A decoloring device according to an embodiment includes a feeding unit on which sheets are loaded. A first sensor unit is downstream of the feeding unit in a sheet transport direction, detects a front position of the sheet fed from the feeding unit, and detects a presence or absence of an identification mark on a front portion of the sheet outside of an image forming area of the sheet. A control unit determines whether or not an image using the decolorable color material is printed on any one or both sides of the sheet based on whether the first sensor detects an identification mark on the front portion of the sheet, and determines whether to perform the decoloring process based on the determination of whether or not an image using the decolorable color material is printed on the sheet.

Hereinafter, the decoloring device according to the embodiment will be described in detail with reference to drawings.

A decoloring device 100 includes a feeding tray 102 in which a sheet S that will be subject to a decoloring process is loaded, a feeding member 104, and a reading unit 106 which reads a first (front) side of the sheet S and a second (rear) side of the sheet S. The decoloring device also includes a decoloring unit 108, a first tray 110 to which a reusable sheet RS (i.e., a decolored sheet) is discharged, and a second tray 112 to which a rejected sheet JS (i.e., a sheet that is determined to not be subject to a decoloring process for reuse) is discharged.

In addition, the decoloring device 100 further includes a first transport path 114 on which a sheet is transported to the first tray 110 from the feeding tray 102, and a second transport path 120 which is connected to the first transport path 114 at a first branch point 116 and a junction 118. In addition, a third transport path 124 branches at a second branch point 122 from the first transport path 114, and discharges a rejected sheet JS (which temporarily stops at a terminal end portion of the first transport path 114) to the second tray 112. The second transport path 120 transports a sheet which is transported from the first branch point 116 toward the junction 118.

In addition, a first reversing gate 126 (i.e., a first branching member) is arranged in the first branch point 116. A sheet which is transported on the first transport path 114 passes by the first reversing gate 126 in an OFF state (which is denoted by a solid line), and is transported toward the second transport path 120 when the first reversing gate is switched (reversed) to an ON state (reversed) which is denoted by a dashed line. A second reversing gate 128 (i.e., a second branching member) is arranged at the second branch point 122. A sheet which is transported on the first transport path 114 passes by the second reversing gate 128 in the OFF state (which is denoted by the solid line) to the first tray 110. In addition, when the second reversing gate 126 is switched (reversed) to the ON state which is denoted by the dashed line, a sheet is transported toward the third transport path 128, and the sheet is fed to the second tray 112.

The feeding tray 102 may be loaded with sheets S of various sizes such as A4, A3, B5, or the like. A sheet which is loaded in the feeding tray 102 is, for example, a sheet on which an image is formed using a decolorable color material (recording material) which can be decolored by being heated to a predetermined temperature or more.

In addition, the feeding tray 102 includes a detecting sensor 130 (i.e., a sensor for detecting start of feeding) which detects a presence or absence of a sheet on the feeding tray 102. When the detecting sensor 130 detects loading of a sheet, a control unit 500 feeds the loaded sheet to the first transport path 114.

The first transport path 114 transports the sheet from the feeding tray 102 to the reading unit 106. The reading unit 106 is arranged along the first transport path 114 downstream of the feeding tray 102 in a sheet transport direction. The reading unit 106 includes, for example, a reading unit such as a Charge Coupled Device (CCD) scanner, or a CMOS sensor. According to the embodiment, the reading unit 106 reads respective images on the first side and the second side of the transported sheet. The reading unit 106 includes a first reading unit 1061 and a second reading unit 1062 which are arranged on opposite sides of the first transport path 114 for reading images on both sides of a transported sheet.

Image data corresponding to an image read by the reading unit 106 is stored in a storage unit 505 which will be described later. For example, when image data corresponding to an image which is decolored is necessary later, it is possible to obtain the image data by storing image data (corresponding to image on a sheet S which is read by the reading unit 106) in the storage unit 505 by converting the image to an electronic form as the image data, before a decoloring process.

The second transport path 120 may transport a sheet S which is transported from the reading unit 106 to the reading unit 106 again by passing through the decoloring unit 108.

The decoloring unit 108 erases a color of an image on a transported sheet. For example, the decoloring unit 108 heats the sheet up to a predetermined decoloring temperature using a heating roller, or the like, in a state of being in contact with the transported sheet, and erases the color of the image which was formed on the sheet with a decolorable color material. For example, the decoloring unit 108 of the decoloring device 100, according to the embodiment includes two decoloring units 1081 and 1082 for the first side and the second side of the sheet, respectively. The decoloring units 1081 and 1082 are arranged on opposite sides of the second transport path 120.

An operating unit 129 includes a touch panel display and various operating keys, and is arranged at the upper part of the main body of the decoloring device 100, for example. The operating key includes a numeric keypad, a stop key, a start key, or the like.

Discharging rollers 117 and 118 discharge a sheet, after a decoloring process, to the first tray 110 and the second tray 112 which are arranged above and below the lower part of the main body. The decoloring device 100 includes a plurality of sheet detecting sensors 131 which detect a sheet which is transported on the first to third transport paths 114, 120, and 124. The sheet detecting sensors 131 may be a micro sensor, or a micro actuator, for example. The sheet detecting sensors 131 are arranged at appropriate positions on the transport path. In addition, transport rollers 132 are appropriately arranged on the transport path.

Figure 4A:
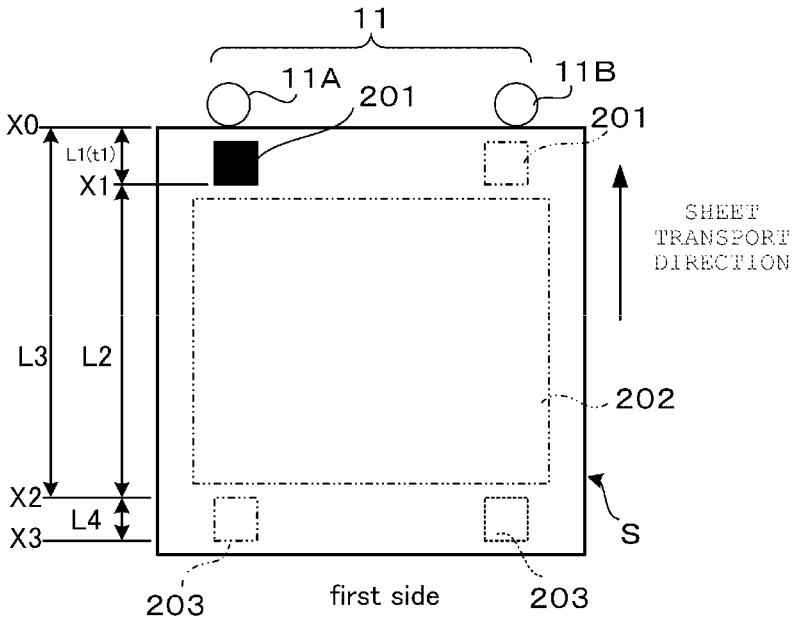
FIGS. 4A and 4B are diagrams illustrating a principle for determining whether or not to perform the decoloring process.

The sheet S is printed with a first identification mark 201 which denotes that the sheet is a reusable sheet on which an image using a decolorable color material is printed, on the first side which is illustrated in FIG. 4A. The first identification mark 201 is printed in a region out of an image printing region 202 when an image is printed using the decolorable color material. The first identification mark 201 is printed on the first side at a predetermined position. The identification mark is printed on the front end side or the rear end side of the sheet, relative to the transport direction (i.e., a first direction), and is performed at one or two portions in a direction which is orthogonal to the sheet transport direction (i.e., a second direction).

Figure 4B:
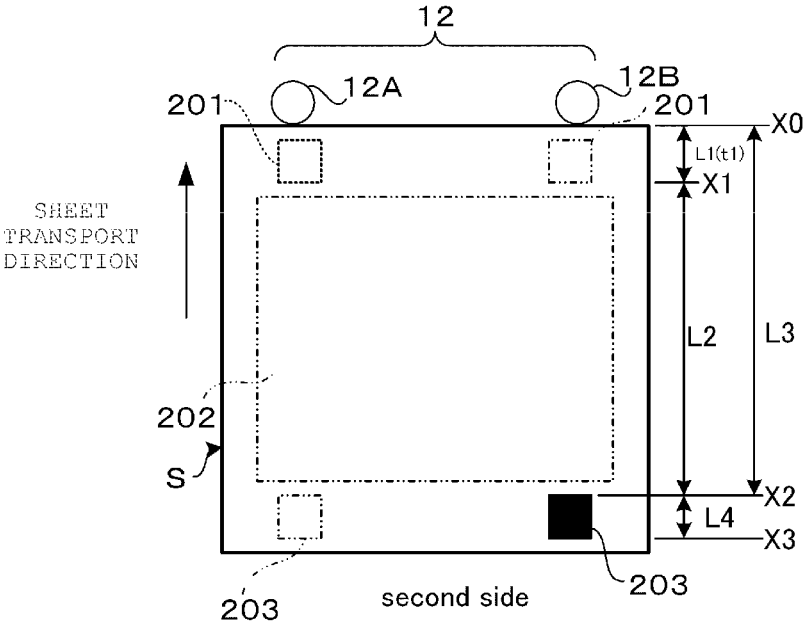
Figure 5A:
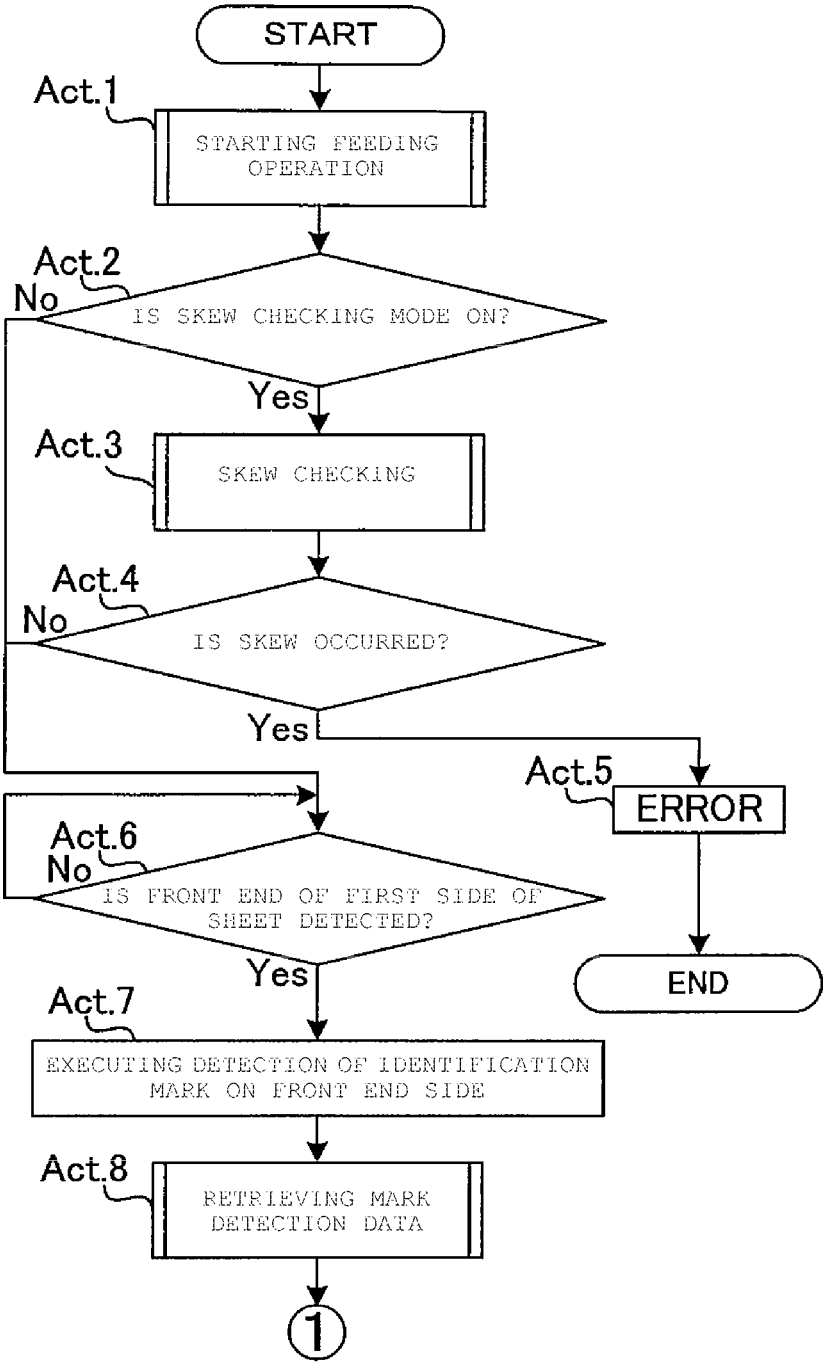
FIGS. 5A to 5D are flowcharts illustrating the method of determining whether or not to perform the decoloring process using the hardware configuration in FIG. 3.
Figure 5B:
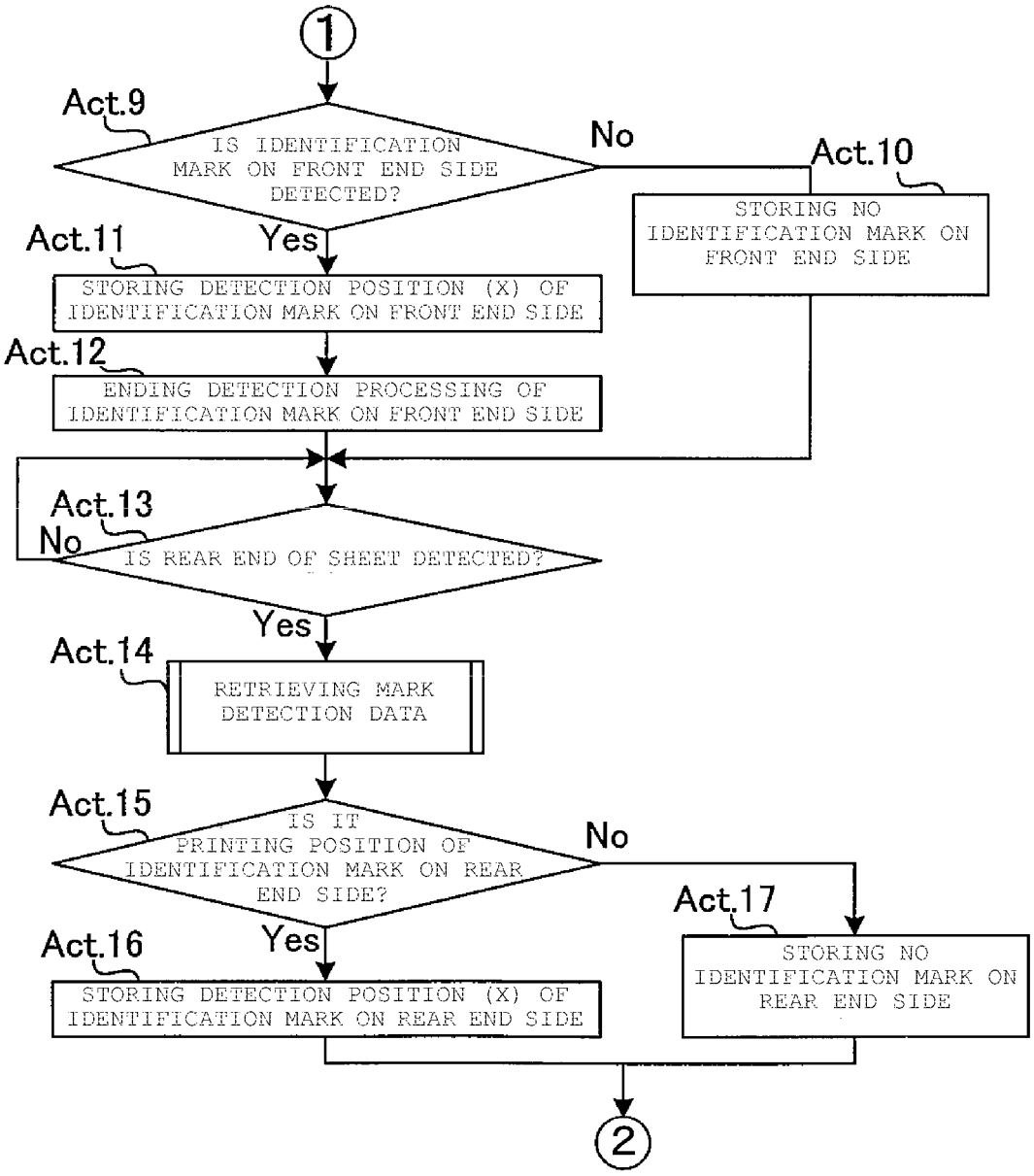
Figure 5C:
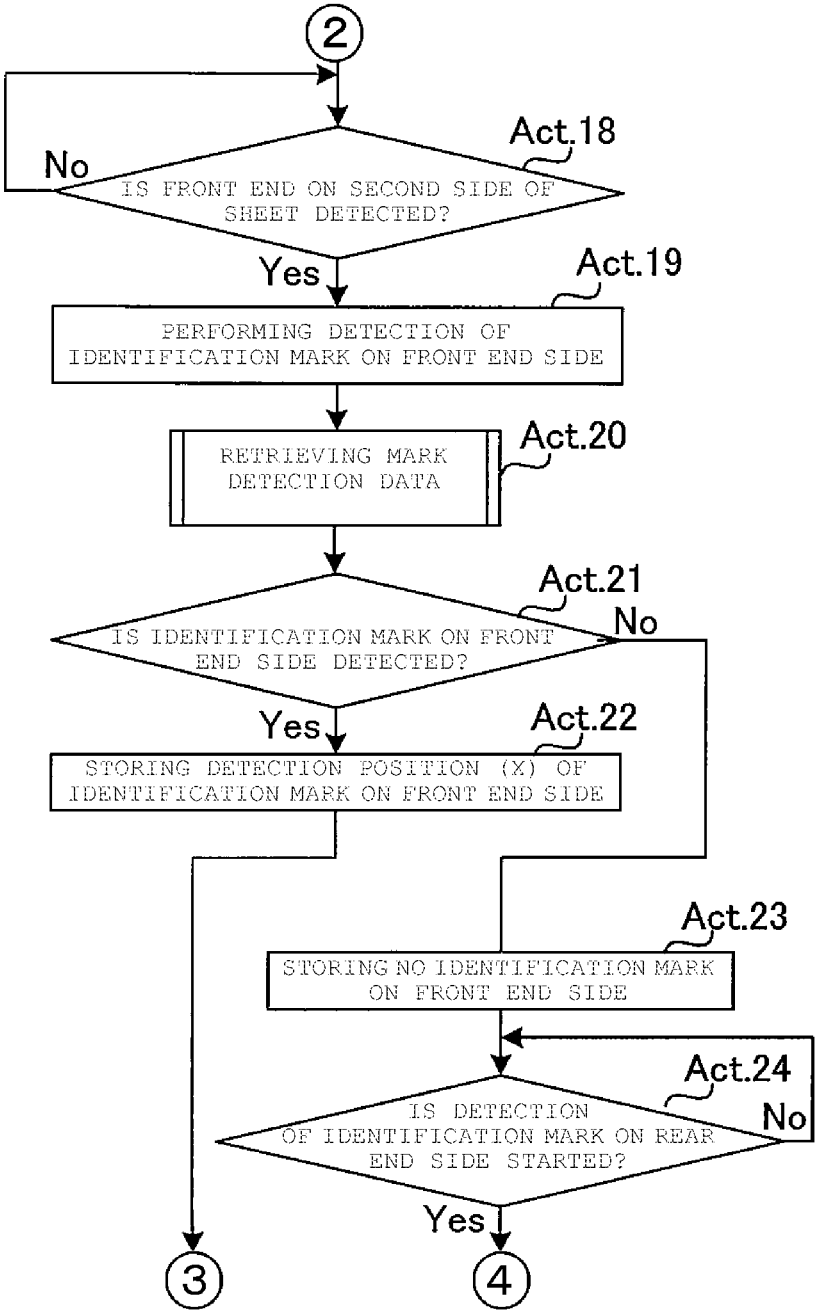
Figure 5D:
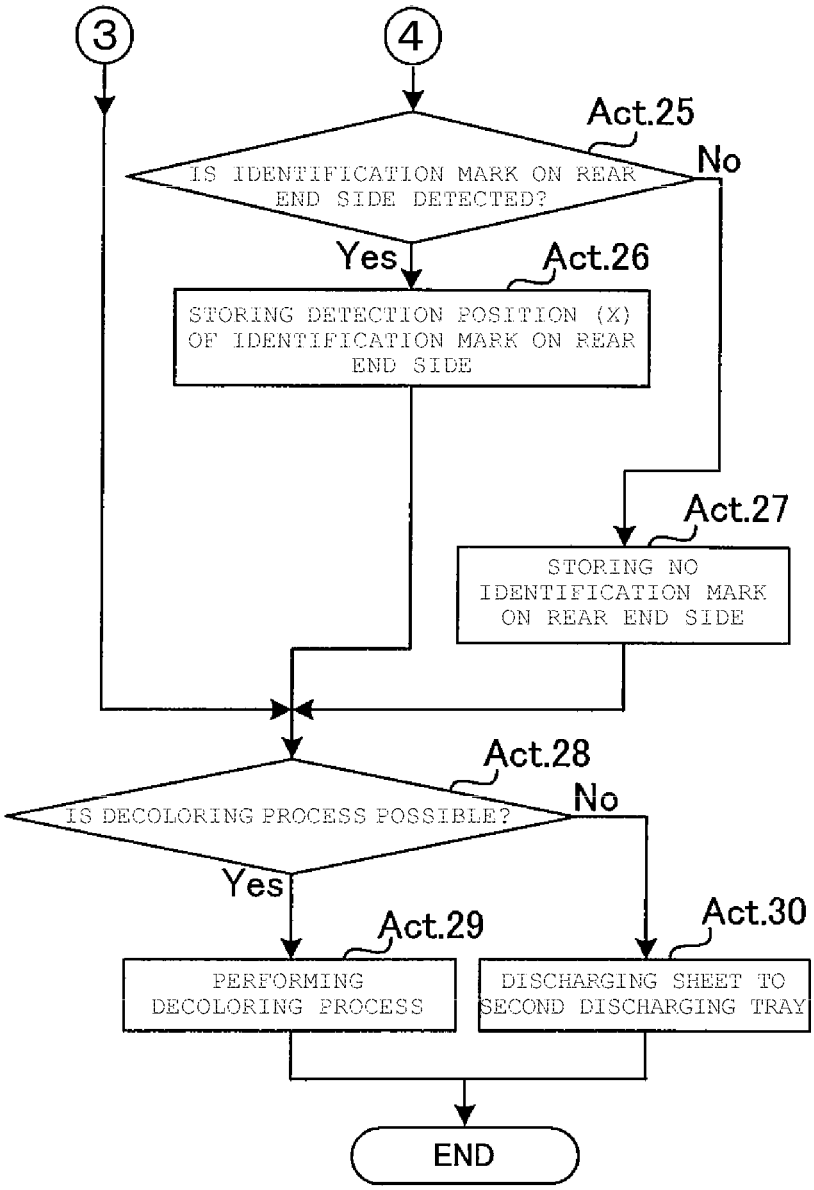

In addition, on the sheet S, a second identification mark 203 which denotes that the sheet is a reusable sheet on which an image using the decolorable color material is printed is printed in a region out of the image printing region 202, on the second side which is illustrated in FIG. 4B, similar to the first side. When printing images on both sides of a sheet using the decolorable color material, positions of the first identification mark 201 (which is printed on the first side of the sheet S which is illustrated in FIG. 4A) and the second identification mark 203 (which is printed on the second side of the sheet S which is illustrated in FIG. 4B) are printed on opposite ends, relative to the first direction. The first identification mark 201 is printed on the first side of the sheet S at only any one of the front end and the rear end along the transport direction of the sheet S. Similarly, the second identification mark 203 is printed on the second side of the sheet S at only any one of the front end and the rear end along the transport direction of the sheet S.

The first identification mark 201 and the second identification mark 203 are printed at detection positions so that they can be detected using a first identification mark detector portion 11 and a second identification mark detector portion 12 (which will be described later). In addition, the length of the first identification mark 201 and the second identification mark 203 in the first direction is differentiated according to a size of a sheet.

Returning to FIG. 1, the sheet S which is loaded in the feeding tray 102 is fed to the first transport path 114 one by one by the feeding member 104. The first identification mark detector portion 11 and the second identification mark detector portion 12 are arranged between the feeding member 104 and the junction 118. The first identification mark detector portion 11 is arranged at a position of a sheet immediately after being fed from the feeding tray 102, and the second identification mark detector portion 12 is arranged downstream of the first identification mark detector portion in the transport direction.

As illustrated in FIG. 4A, the first identification mark detector portion 11 includes a first skew sensor 11A and a second skew sensor 11B, which may be light transmission sensors. The first skew sensor 11A and the second skew sensor 11B are arranged with a predetermined gap between them, in the second direction, and detect the first identification mark 201 and the second identification mark 203. In the first skew sensor 11A and the second skew sensor 11B, a projection device and a light receiving device are arranged so as to face each other by interposing a sheet S which is transported on the first transport path 114 therebetween.

The first skew sensor 11A and the second skew sensor 11B detect whether the sheet S is transported straight or is obliquely transported depending on whether or not a transported front end of the transported sheet S is simultaneously detected. In addition, when transmission light from the projection device is shielded by the first identification mark 201 or the second identification mark 203, a signal from the light receiving device denotes a light shielding state (ON). In this case, it is possible to determine that an image on the sheet S is printed using a decolorable color material, as described in FIGS. 4A and 4B. However, whether the read identification mark is printed on the first side or the second side is unclear. The fact becomes clear by detecting the second identification mark 203 using the second identification mark detector portion 12. In addition, the projection device may cause a sufficient amount of transmission light to be obtained by setting brightness low at a time of detecting skew in which the front end of the sheet is detected, and setting the brightness high when detecting the identification mark.

As illustrated in FIG. 4A, a size of the fed sheet S may be specified by detecting an identification mark after a time (t1), after detecting the front end of the sheet when the identification mark is printed on the front end of the sheet S in the transport direction, for example. In this case, since the length of the identification mark is different according to a size of the sheet, it is possible to specify the size of the sheet by measuring the time (t1), and to specify the length of the sheet in the first direction.

On the other hand, when the identification mark is printed on the rear end side of the sheet S in the transport direction, since the first identification mark detector portion 11 detects an image in the image printing region 202 of the sheet S before the size of the sheet S is specified, it is not possible to distinguish the image from an identification mark which is detected thereafter. However, it is possible to specify the length of the sheet S based on a transport speed of the sheet S by measuring a time until the rear end of the sheet S is detected, after detecting the front end of the sheet S.

Accordingly, as illustrated in FIG. 4A, it is possible to recognize whether or not an identification mark is printed by retrieving whether or not recognition data of the identification mark is present from a distance L3 from the front end of the sheet S to a printing position of the identification mark corresponding to a sheet size over the image printing region 202 to a distance L4. For example, a distance of a detected image is stored after detecting the front end of the sheet S, and when a subsequent image is detected, distance information of the newly detected image (i.e., image distance information) is updated. In addition, when detecting the rear end of the sheet S, it is determined that it is not possible to detect an identification mark when the latest image distance information is in the image printing region 202. Accordingly, in such a case, it is determined that the image of the latest image distance information is the identification mark when the latest image distance information is in a region out of the image printing region 202.

In this manner, a case in which the identification mark is present on the front end of the sheet in the transport direction, and a case in which the identification mark is present on the rear end are both caused due to a direction of the sheet when loading the sheet S into the feeding tray 102.

The second identification mark detector portion 12 includes a first rear side mark detecting sensor 12A and a second rear side mark detecting sensor 12B, which may be light reflecting sensors or light transmission sensors, as illustrated in FIG. 4B. According to the embodiment, the second identification mark detector portion 12 uses light reflecting sensors. The first rear side mark detecting sensor 12A and the second rear side mark detecting sensor 12B are arranged with a predetermined distance along the second direction on the rear side of the sheet S which is transported on the first transport path 114. The first rear side mark detecting sensor 12A and the second rear side mark detecting sensor 12B receive light from the projection device, and light which is reflected on the rear side of the sheet S using the light receiving device.

When the second identification mark 203 is printed on the second side, the first rear side mark detecting sensor 12A or the second rear side mark detecting sensor 12B detects that light from the projection device is not reflected on the light receiving device by being shielded by the second identification mark 203. For this reason, when the reflecting light from the projection device is shielded by the second identification mark 203, a signal from the light receiving device denotes a non-light reflecting state. In this case, the image on the second side of the sheet S is determined to be an image which is printed using the decolorable color material.

According to the embodiment, the first identification mark detector portion 11 determines whether the identification mark which is printed on the sheet S is printed on the first side, the second side, or both the sides of the sheet S. The determination is based on a detection position (X) of the identification mark in the first direction based on a signal of detecting the identification mark by the first identification mark detector portion 11, and a detection position (X) of the identification mark in the first direction based on a signal of detecting the identification mark by the second identification mark detector portion 12.

The control unit 500 obtains detection information which is detected by the first identification mark detector portion 11 and the second identification mark detector portion 12 as a coordinate (distance) in the sheet transport direction by setting the front end position (X0) of the sheet S as a starting point. That is, a position coordinate of the identification mark which is printed on the front end side of the sheet S is set to X1 (distance L1 from front end position X0), a detection coordinate position of the identification mark which is printed on the rear end side of the sheet S from the start of the detection is set to X2 (distance L2 from coordinate position X1, distance L3 from front end position X0), and a detection coordinate position of the identification mark on the rear end side in the first direction is set to X3 (distance L4 from coordinate position X2). In addition, L3=L1+L2.

When a mark detection position (X) using the first identification mark detector portion 11 and a mark detection position (X) using the second identification mark detector portion 12 are in a range of X0<X<X1 or X2<X<X3, and are in the same range together, it is recognized that a detected identification mark is the second identification mark 203 on the second side, and it is determined that an image using the decolorable color material is printed on the second side. In addition, when the mark detection position (X) using the first identification mark detector portion and the mark detection position (X) using the second identification mark detector portion 12 are in a range of X0<X<X1 and X2<X<X3, and are in a different range, it is recognized that detected identification marks are the first identification mark 201 on the first side and the second identification mark 203 on the second side, and it is determined that images using the decolorable color material are printed on both sides of the sheet S.

In addition, when the mark detection position (X) using the first identification mark detector portion 11 is in a range of X0<X<X1, or X2<X<X3, and it is not possible to detect a mark using the second identification mark detector portion 12, it is recognized that a detected identification mark is the first identification mark 201 on the first side, and it is determined that an image using the decolorable color material is printed on the first side of the sheet S.

In addition, when the first identification mark detector portion 11 and the second identification mark detector portion 12 may not detect a mark together, it is recognized that identification marks are not printed on both sides of the sheet, and the decoloring process is determined not to be possible.

In addition, when the detection position (X) is in a range of X1<X<X2, it is determined that detected information is not the identification mark.

That is, in a case of the printing on both sides, the first identification mark 201 and the second identification mark 203 are not printed overlapping on the front end side or the rear end side in the transport direction, on the first side and the second side of the sheet S. In addition, the identification mark which is detected by the second identification mark detector portion 12 is the second identification mark 203 which is printed on the second side of the sheet S. Therefore, when the mark position (X) which is detected by the first identification mark detector portion 11 and the mark position (X) which is detected by the second identification mark detector portion 12 are in the same range, it means that the first identification mark detector portion 11 detects (ON) that transmission light is shielded by the second identification mark 203 which is printed on the second side of the sheet S. Accordingly, it is possible to determine that an image is printed using the decolorable color material on the second side of the sheet S.

Due to this, when the mark position (X) which is detected by the first identification mark detector portion 11 and the mark position (X) which is detected by the second identification mark detector portion 12 are in a different range, it means that the first identification mark detector portion 11 detects that transmission light is shielded by the first identification mark 201 which is printed on the first side of the sheet S. Accordingly, in this case, it is recognized that the first identification mark 201 is printed on the first side of the sheet S, and the second identification mark 203 is printed on the second side of the sheet S, and it is possible to determine that images using the decolorable color material are printed on both sides.

In addition, when there is detection information of the mark position from the first identification mark detector portion 11, but there is no detection information of the mark position from the second identification mark detector portion 12, the second identification mark 203 is not printed on the rear side of the sheet S. Accordingly, the first identification mark 201 which is printed on the first side of the sheet S is recognized by the first identification mark detector portion 11, and it is determined that an image using the decolorable color material is printed on the first side of the sheet S.

In this case, whether the second side of the sheet S is blank, or an image is printed using a non-decolorable material is unclear. Accordingly, when an image is present on the second side which is read in the reading unit 106, the control unit determines that the image is formed as a non-decolored image, and determines that the decoloring process is not possible. On the other hand, when an image is not present on the second side, the control unit may determine that the decoloring process is possible by determining that the second side is blank.

On the other hand, when position information of the identification mark is not output from the first identification mark detector portion 11 and the second identification mark detector portion 12, it is determined to be one of the following cases.

(1) Images using the decolorable color material are not printed on both sides of the sheet S, or the images are printed using non-decolorable color material, even when the images are printed.

(2) Images are not formed on both sides of the sheet S, and the sheet is blank.

When it is determined to be the case of (1), it is determined that the decoloring process is not possible. When it is determined to be the case of (2), it is determined that the decoloring process is not necessary. The sheet which is determined not to be possible or necessary for the decoloring process in this manner is transported to a cassette for rejected sheet 112 without being subject to the decoloring process.

Figure 3:
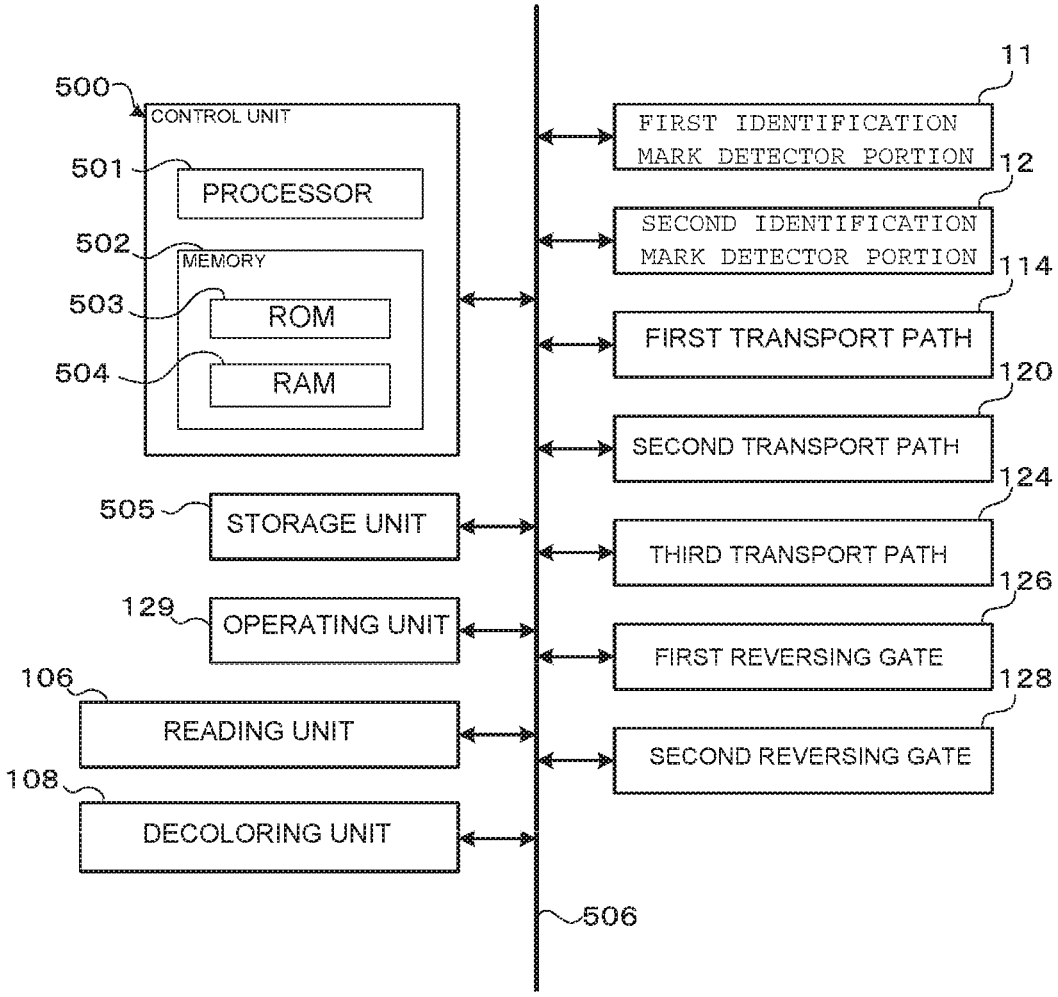
FIG. 3 is a block diagram which illustrating a hardware configuration of the decoloring device.

FIG. 3 is a block diagram which illustrates a hardware configuration of the decoloring device in FIG. 1. The decoloring device 100 includes the first identification mark detector portion 11, the second identification mark detector portion 12, the control unit 500, the storage unit 505, the first transport path 114, the second transport path 120, the reading unit 106, the decoloring unit 108, the operating unit 129, the first reversing gate 126, and the second reversing gate 128. Each component of the decoloring device 100 is connected through a bus 406. The control unit 500 controls the start of feeding of the sheet S which is loaded into the feeding tray 102 when obtaining an ON signal from a start button of the operating unit 129.

In the operating unit 129, it is possible to select a skew checking mode in which skew checking is performed. When the skew checking mode is selected (ON), the first identification mark detector portion 11 starts the skew checking.

The control unit (controller) 500 includes a processor 501 including a Central Processing Unit (CPU) or a Micro Processing Unit (MPU), and a memory 502. The control unit 500 controls the reading unit 106, the decoloring unit 108, the operating unit 129, the first transport path 114, the first reversing gate 126, and the second reversing gate 128. In addition, the control unit 500 makes a determination on whether or not to perform the decoloring process based on a detection of meandering of the sheet S, a detection of a size of the sheet S, and a detection of a presence or absence of the identification mark using detection information which is detected in the first identification mark detector portion 11.

The memory 502 is, for example, a semiconductor memory, and includes a Read Only Memory (ROM) 503 which stores various control programs, and a Random Access Memory (RAM) 504 which provides a temporary work area to the processor 501. For example, the ROM 503 stores a printing position of the identification mark, the distances L1, L2, L3, and L4 corresponding to a size of the sheet which are illustrated in FIGS. 4A and 4B, and the table in FIG. 4C. In addition, pieces of detection information which are detected in the first identification mark detector portion 11 and the second identification mark detector portion 12 are stored in the storage unit 505.

A flow chart for determining whether or not to perform the decoloring process is described based on flowcharts in FIGS. 5A to 5D.

In Act 1, feeding of a sheet which is loaded onto the feeding tray 102 is started, and the process proceeds to Act 2.

In Act 2, it is determined whether or not a skew checking mode is on, and the process proceeds to Act 3 when the skew checking mode is on. If not, the process proceeds to Act 6.

In Act 3, the front end of the sheet is detected by the first skew sensor 11A and the second skew sensor 11B of the first identification mark detector portion 11, and the process proceeds to Act 4.

In Act 4, when the front end of the sheet is detected at a different timing by the first skew sensor 11A and the second skew sensor 11B of the first identification mark detector portion 11, it is determined that skew has occurred in the sheet, and the process proceeds to Act 5. When the front end of the sheet is detected at the same timing, it is determined that skew has not occurred, and the process proceeds to Act 6.

In Act 5, an error handling such as a stop of sheet feeding is performed, and the process for determining whether or not to perform the decoloring process is ended.

In Act 6, when the first identification mark detector portion 11 detects the front end of the sheet, the process proceeds to Act 7.

In Act 7, a detection of the identification mark on the front end side is performed by the first identification mark detector portion 11. When the identification mark is printed on the front end of the sheet, the identification mark is printed at approximately the same position regardless of a size of the sheet. Accordingly, the detection of the mark between the detection of the front end of the sheet and the detection of the distance (L1) is performed, detected data is stored in the storage unit 505, and the process proceeds to Act 8.

In Act 8, the data which is stored in the storage unit 505 is retrieved, and the process proceeds to Act 9.

In Act 9, when the identification mark on the front end is not detected, the process proceeds to Act 10, and when the identification mark is detected, the process proceeds to Act 11.

In Act 10, the fact that there is no identification mark on the front end is stored in the storage unit 505, and the process proceeds to Act 13.

In Act 11, the detection position (X) of the detected identification mark on the front end is stored, and the process proceeds to Act 12. In addition, due to the detection position (X) of the identification mark on the front end, a size of the sheet can be determined. In this case, the detection position (X) of the identification mark on the front end is present in the range of $X0<X<X1$, as illustrated in FIG. 4A.

In Act 12, the detection process of the identification mark on the front end is ended, and the process proceeds to Act 13.

In Act 13, when the rear end of the sheet is detected, the process proceeds to Act 14. When the first identification mark detector portion 11 detects the rear end of the sheet, the size of the sheet can be determined. It is effective when the identification mark on the front end of the sheet is not detected.

In Act 14, detection data of detection of the rear end of the sheet is retrieved, and the process proceeds to Act 15.

In Act 15, when the detection position (X) of the identification mark on the rear end of the mark detection data is in the range of $X2<X<X3$, as illustrated in FIG. 4A, it is determined to be a normal identification mark on the rear end, and the process proceeds to Act 16. In addition, when detection position (X) of the identification mark on the rear end of the mark detection data is not in the range of $X2<X<X3$, the fact that there is no identification mark on the rear end is stored in the storage unit 505, and the process proceeds to Act 18.

In the processes from Act 6 to Act 17, whether the detection position (X) of the identification mark is present in the range of $X0<X<X1$, in the range of $X2<X<X3$, or the identification mark on the front end side is not present is stored in the storage unit 505 using the detection information which is detected by the first identification mark detector portion 11.

In Act 18, when the detection of the front end of the sheet is performed by the second identification mark detector portion 12, the process proceeds to Act 19.

In Act 19, as illustrated in FIG. 4B, the mark detection is performed between the detection of the front end of the sheet and the detection of the distance (L1), by the second identification mark detector portion 12, the detected data is stored in the storage unit 505, and the process proceeds to Act 20.

In Act 20, the data which is stored in the storage unit 505 is retrieved, and the process proceeds to Act 21.

In Act 21, when the identification mark on the front end is detected, the process proceeds to Act 22, and when the identification mark is not detected, the process proceeds to Act 23.

In Act 22, the detection position (X) of the identification mark on the front end is stored in the storage unit 505, and the process proceeds to Act 28. In this case, as illustrated in FIG. 4B, the detection position (X) of the identification mark on the front end is in the range of $X0<X<X1$.

In Act 23, the fact that there is no identification mark on the front end is stored in the storage unit 505, and the process proceeds to Act 24.

In Act 24, when the detection of the identification mark on the rear end is started, the process proceeds to Act 25. Since the size of the sheet is obtained between Act 6 to Act 15, as illustrated in FIG. 4B, the detection of the identification mark may be performed between the distance L3 and the distances L3+L4.

In Act 25, when the identification mark on the rear end is detected, the process proceeds to Act 26, and when the identification mark is not detected, the process proceeds to Act 27.

In Act 26, the detection position of the identification mark (X) on the rear end is stored in the storage unit 505, and the process proceeds to Act 28. In this case, as illustrated in FIG. 4B, the detection position of the identification mark (X) on the rear end is in the range of $X2<X<X3$.

In Act 27, the fact that there is no identification mark on the rear end is stored in the storage unit 505, and the process proceeds to Act 28.

In Act 28, the determination of whether or not to perform the decoloring process is made. The determination of whether or not to perform the decoloring process is made by comprehensively determining the presence or absence of the identification mark on the front end e, and the presence or absence of the identification mark on the rear end on the first side and the second side of the sheet (such data being stored in the storage unit 505). Specifically, the determination is made as illustrated in FIG. 4C. That is, when it is determined that the identification mark is printed on the first side, the second side, or on both sides by the information on the detection positions (X) of the identification marks of the first identification mark detector portion 11 and the second identification mark detector portion 12, and the information of no detection, the decoloring process is determined to be possible, and when it is determined that the identification mark is not printed on the first side and the second side, the decoloring process is determined not to be possible, or necessary.

In Act 28, the sheet which is determined to be a sheet on which the decoloring process may be performed is subject to the decoloring process in which a color of an image on a transported sheet is erased in the decoloring unit 108 (Act 29). The decoloring unit 108 heats the sheet up to a predetermined decoloring temperature using a heating roller, or the like, in a state of being in contact with the transported sheet, and decolors the color of the image that was formed on the sheet using the decolorable color material. In Act 28, a sheet in which the decoloring process is determined to be not possible, or not to be necessary is discharged to the second tray 112 without being subject to the decoloring process (Act 30).

In the above described embodiment, the case in which the identification mark is printed on the front end or the rear end in the sheet transport direction on the first side and the second side of the sheet S is described. However, the identification mark may be detected on the front end of the sheet, regardless of the direction of the sheet when the sheet is loaded onto the feeding tray 102, by printing the identification mark on both the front end and the rear end in the sheet transport direction. At this time, when the identification mark is printed on only one side, the identification mark is printed at a diagonal position of the front end and the rear end of the sheet. In addition, when an image using the decolorable color material is printed on both sides of the sheet, the identification marks are printed according to the first skew sensor 11A and the second skew sensor 11B on the left and right of the front end side and the rear end side in the sheet transport direction, respectively. In this case, the identification mark may be printed on any one of the first side and the second side. According to the printing method of the identification mark, it is possible to make the determination on whether or not to perform the decoloring process using only the first identification mark detector portion 11 which is the light transmission type, and the second identification mark detector portion 12 is not necessary.

In this case, when the printing position of the identification mark is set to the left side when viewed from the sheet transport direction, and the identification mark on the front end side of the sheet S is detected by the first skew sensor 11A of the first identification mark detector portion 11, a determination that the identification mark is printed on the first side may be made. At this time, when the identification mark on the front end of the sheet is detected by the second skew sensor 11B, a determination that the identification mark is printed on the second side may be made. In addition, when the identification mark on the front end of the sheet is detected by first skew sensor 11A and the second skew sensor 11B at the same time, a determination that images using the decolorable color material are printed on both the first side and the second side may be made.

According to the embodiment, when printing an image on a sheet using the decolorable color material, and using the skew sensor, it is possible to set a sheet on which the identification mark is printed at a predetermined position of the sheet to a target of the decoloring process, and to determine sheets excluding the sheet to be sheets which are not suitable for the decoloring process.

In addition, it is possible to determine whether or not to perform the decoloring process based on a printing position and the number of printing of the identification mark, and detection timing, or the like, of the identification mark.

In addition, according to the embodiment, the second identification mark detector portion 12 detects the second identification mark which is printed on the second side of the sheet using the reflecting sensor, however, the second identification mark detector portion may detect the first identification mark which is printed on the first side of the sheet.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A method of determining whether or not to perform a decoloring process on a sheet, the method comprising the steps of:

detecting a front position of a sheet fed in a sheet transport direction;

detecting a presence or absence of an identification mark on a front portion of the sheet outside of an image forming area of the sheet, after detecting the front position of the sheet, wherein the identification mark includes size information of the sheet;

determining whether an image using the decolorable color material is printed on any one or both sides of the sheet based on whether an identification mark is detected on the front portion of the sheet; and determining whether to perform the decoloring process based on the determination of whether an image using the decolorable color material is printed on the sheet.

2. The method according to claim 1, further comprising:

detecting a presence or absence of an identification mark on a rear portion of the sheet outside of the image forming area of the sheet, after detecting the presence or absence of an identification mark on the front portion of the sheet, wherein the step of determining whether an image using the decolorable color material is printed on any one or both sides of the sheet is further based on whether an identification mark is detected on the rear portion of the sheet.

3. The method according to claim 1, further comprising:

determining a presence or absence of a skew of the sheet based on the detection of the front portion of the sheet, wherein the step of determining whether to perform the decoloring process is further based on whether a skew of the sheet is determined to be present or absent.

4. The method according to claim 1, wherein the identification mark is printed on a position diagonal to and outside of the image printing region.

5. The method according to claim 1, wherein the determination is that an image using decolorable material is printed on both sides of the sheet when the identification mark is detected outside of and to the left and right side of the image forming area.

6. A decoloring device comprising:

a feeding unit on which sheets are loaded;

a first sensor unit arranged downstream of the feeding unit in a sheet transport direction, configured to detect a front position of the sheet fed from the feeding unit, and configured to detect a presence or absence of an identification mark on a front portion of the sheet outside of an image forming area of the sheet, wherein the identification mark includes size information of the sheet; and a control unit configured to determine whether an image using the decolorable color material is printed on any one or both sides of the sheet based on whether the first sensor detects an identification mark on the front portion of the sheet, and to determine whether to perform the decoloring process based on the determination of whether an image using the decolorable color material is printed on the sheet.

7. The device according to claim 6, further comprising:

a second sensor unit arranged downstream of the first sensor unit in a sheet transport direction and configured to detect a presence or absence of an identification mark on a rear portion of the sheet outside of the image forming area of the sheet, wherein the control unit determines whether an image using the decolorable color material is printed on any one or both of the sheets based further on whether the second sensor detects an identification mark on the rear portion of the sheet.

8. The device according to claim 6, wherein the control unit determines a presence or absence of skew of the sheet based on the detection of the front position of the sheet detected by the first sensor unit, and determines whether to perform the decoloring process based further on whether a skew of the sheet is determined to be present or absent.

9. The device according to claim 6, wherein the identification mark is printed on a position diagonal to and outside of the image printing region.

10. The device according to claim 6, wherein the determination is that an image using decolorable material is printed on both sides of the sheet when the identification mark is detected outside of and to the left and right side of the image forming area.

11. A method of processing a sheet comprising the steps of:

detecting a presence or absence of an identification mark on a portion of the sheet outside of an image forming area of the sheet;

determining whether an image using a decolorable color material is printed on any one or both sides of the sheet based on whether an identification mark is detected on the sheet, wherein the identification mark includes size information of the sheet;

determining whether to perform the decoloring process based on the determination of whether an image using the decolorable color material is printed on the sheet; and controlling conveyance of the sheet so that the sheet is conveyed to a decoloring unit and decolored if it determined to perform the decoloring process, and the sheet is conveyed to a rejected sheet tray without being conveyed to the decoloring unit if it is determined to not perform the decoloring process.

12. The method according to claim 11, further comprising:

determining a presence or absence of a skew of the sheet based on the detection of the front portion of the sheet, wherein the step of determining whether to perform the decoloring process is further based on whether a skew of the sheet is determined to be present or absent.

13. The method according to claim 11, wherein the identification mark is printed on a position diagonal to and outside of the image printing region.

14. The method according to claim 11, wherein the determination is that an image using decolorable material is printed on both sides of the sheet when the identification mark is detected outside of and to the left and right side of the image forming area.

* * * * *